US006272995B1

(12) United States Patent
Schmidt et al.

(10) Patent No.: US 6,272,995 B1
(45) Date of Patent: Aug. 14, 2001

(54) HIGH PRECISION FUZE FOR A MUNITION

(75) Inventors: William Marc Schmidt, Batavia, OH (US); James Arthur Hewlett, Loudon, TN (US); Patrick Dwayne McGregor, Loveland, OH (US); Ezra Stearns Waller, Sharonville, OH (US); Donald Robert Helton, Batavia, OH (US)

(73) Assignee: KDI Precision Products, Inc., Cincinnati, OH (US)

( * ) Notice: Subject to any disclaimer, the term of this patent is extended or adjusted under 35 U.S.C. 154(b) by 0 days.

(21) Appl. No.: 09/395,806

(22) Filed: Sep. 14, 1999

(51) Int. Cl.[7] ..... F42C 9/04; F42C 15/04

(52) U.S. Cl. ..... 102/209; 102/207; 102/487; 102/489; 102/497

(58) Field of Search ..... 102/487, 489, 102/497, 207, 209

(56) References Cited

U.S. PATENT DOCUMENTS 3,112,703 * 12/1963 Urdapilleta ..... 102/487
3,342,998 * 9/1967 Anderson ..... 102/207
3,877,378 * 4/1975 Clark et al. ..... 102/71
3,967,556 * 7/1976 Post et al. ..... 102/70.2
4,665,332 * 5/1987 Meir ..... 310/77
4,831,934 * 5/1989 Golay et al. ..... 102/209
5,635,667 * 6/1997 Boyer et al. ..... 102/487

* cited by examiner

*Primary Examiner*—Charles T. Jordan
*Assistant Examiner*—Lulit Semunegus
(74) *Attorney, Agent, or Firm*—Harness, Dickey & Pierce, PLC

(57) ABSTRACT

A high precision electro-mechanical fuze mechanism for a munition such as a hand grenade. The fuze mechanism includes an electromagnetic signal generator having an armature, a permanent magnet, a coil and a magnetic impulse generator (MIG) member. The armature is pre-loaded during assembly through the use of a spring. Releasing an actuating lever of the grenade allows the armature to begin spinning and to dissipate the energy stored by the spring. This causes a current to be electromagnetically generated in the coil, which is transmitted to an electronic control circuit in the fuze mechanism. The electronic control circuit implements two time delays from two separate timers which each must time out before the control circuit can send an electric firing signal to an electric detonator. Movement of the armature also causes a simultaneous movement of a rotor, which moves a stab detonator into a position closely adjacent the electric detonator. Detonation of the electric detonator immediately causes detonation of the stab detonator, which in turn detonates the primary explosive charge of the munition.

20 Claims, 13 Drawing Sheets

FIG 1
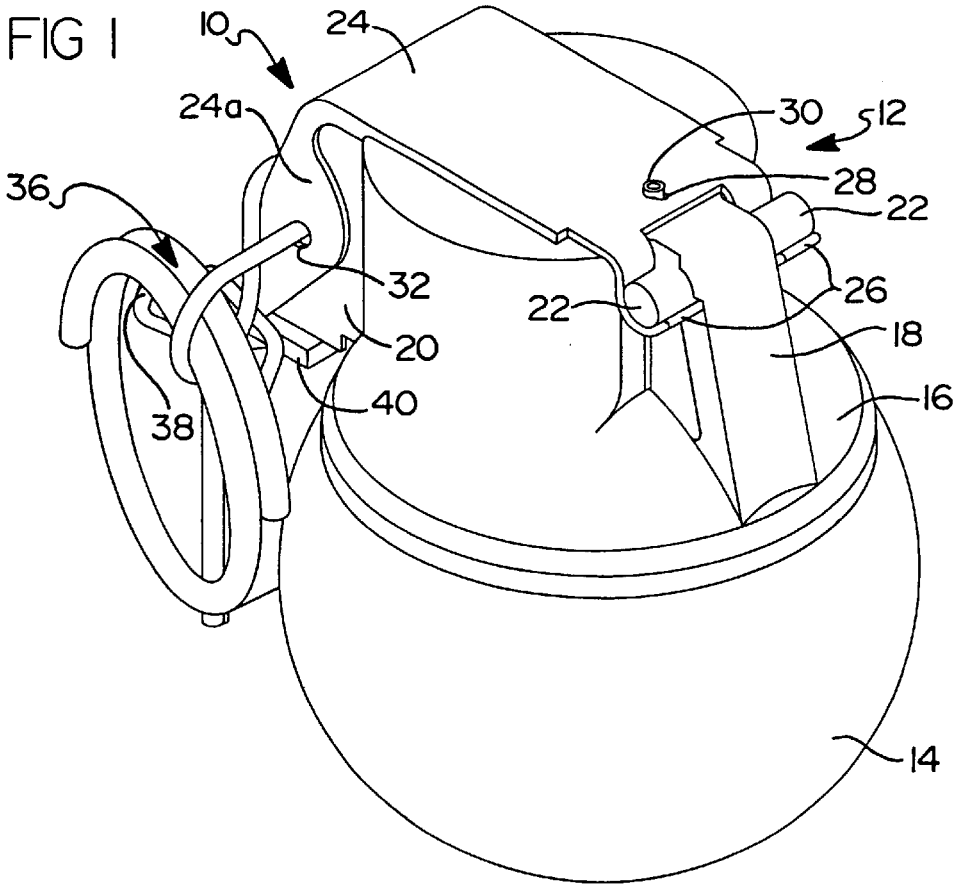
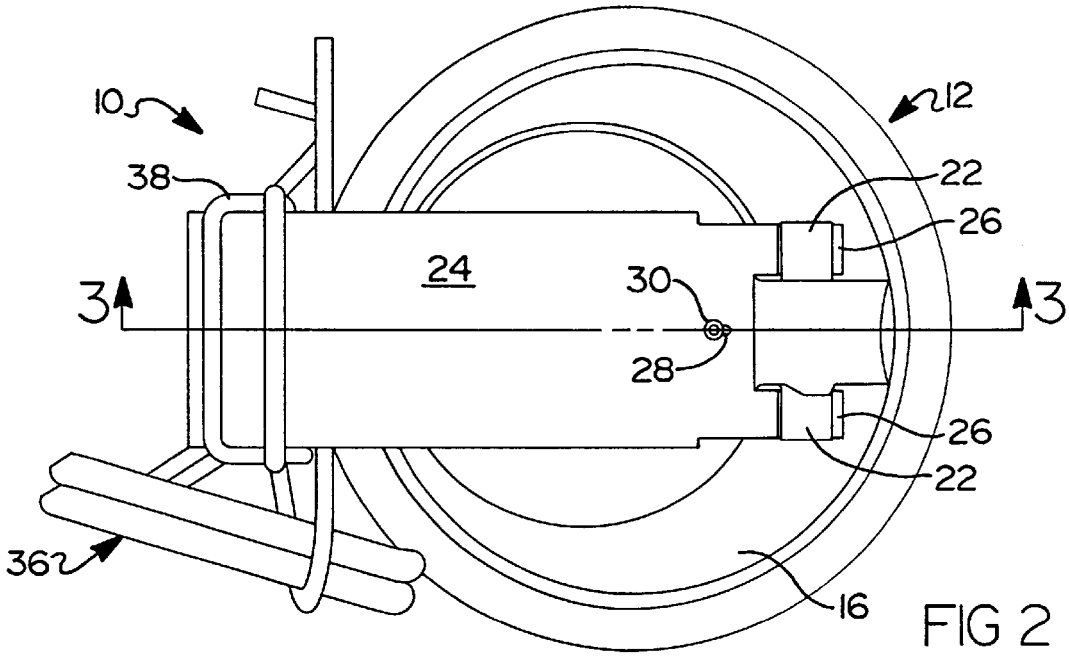
FIG 2

FIG 3
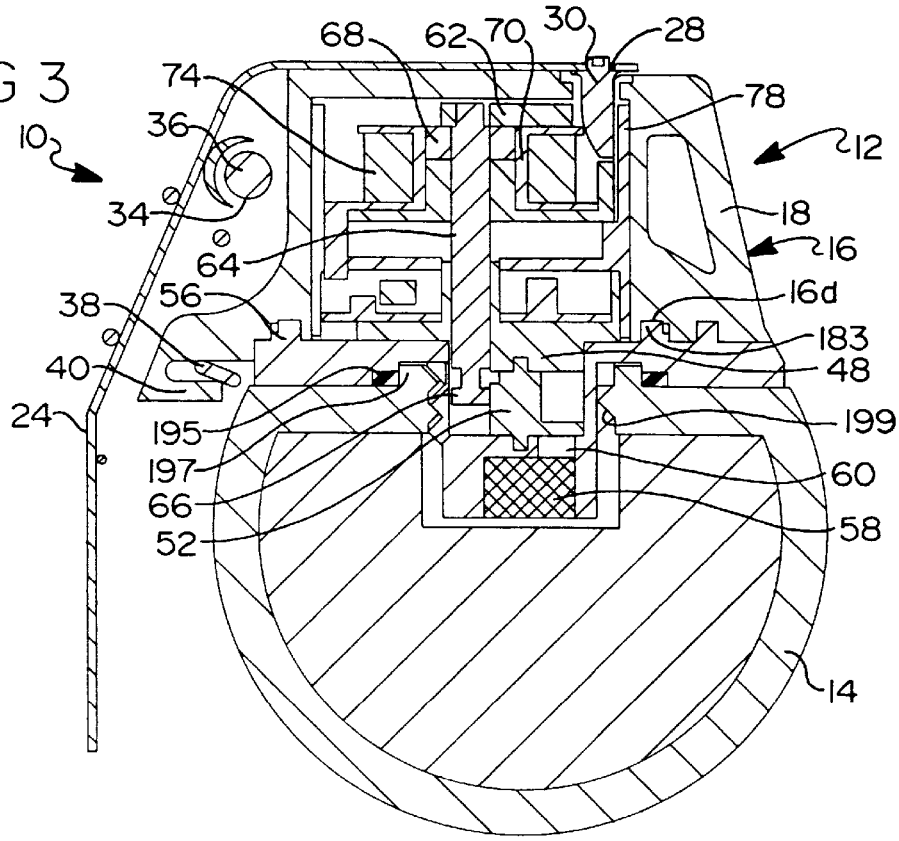
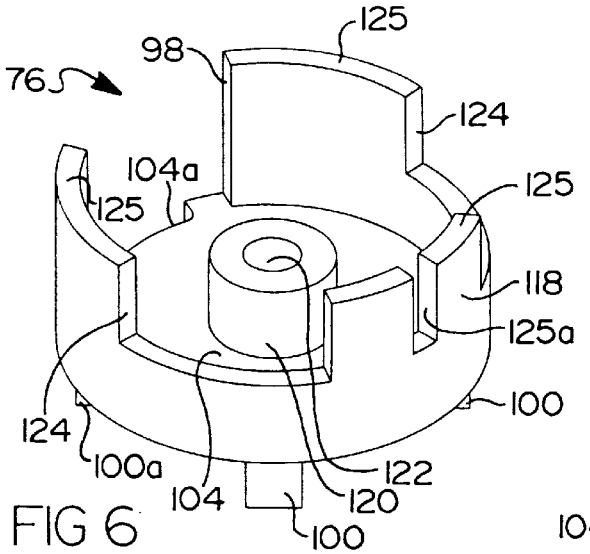
FIG 6
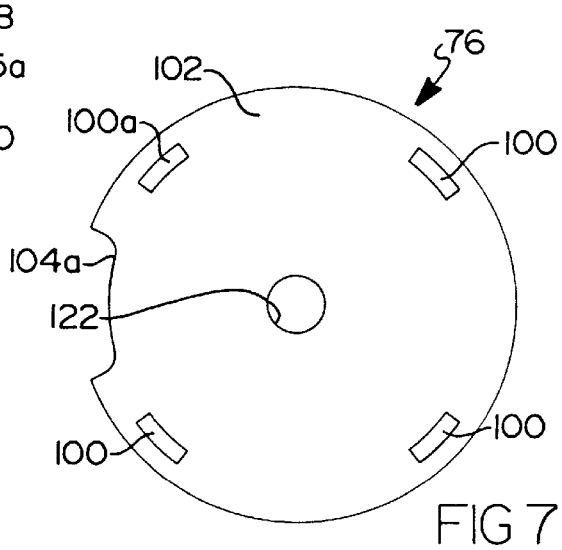
FIG 7

FIG 11
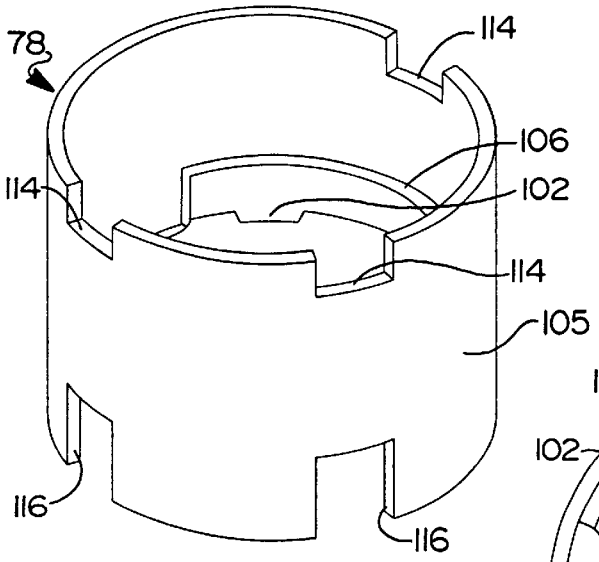
FIG 12
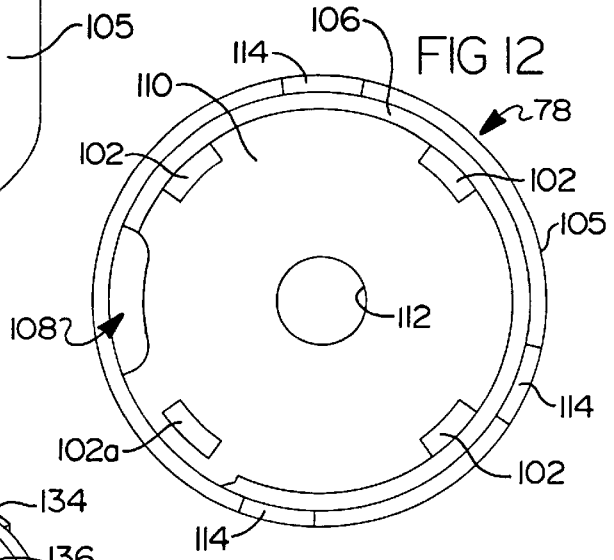
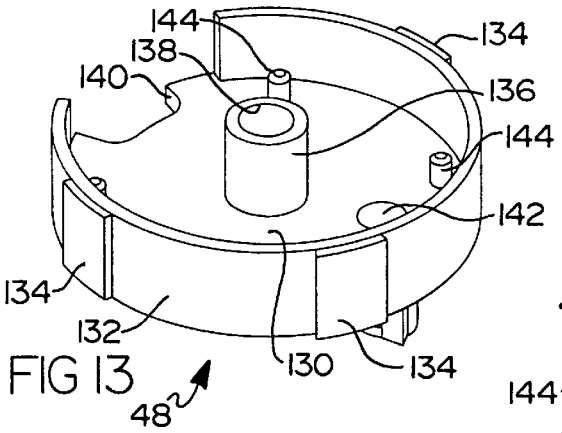
FIG 13
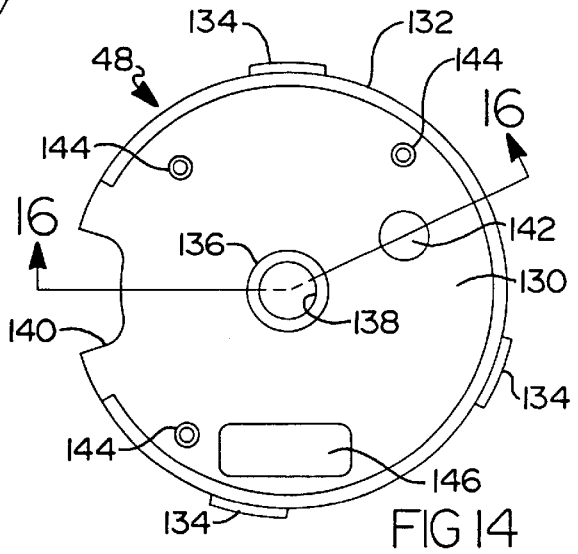
FIG 14

FIG 15
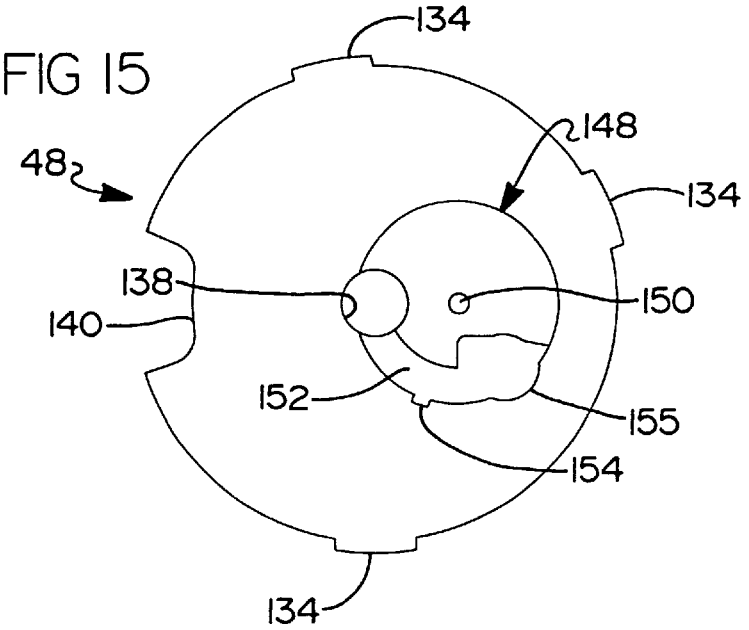
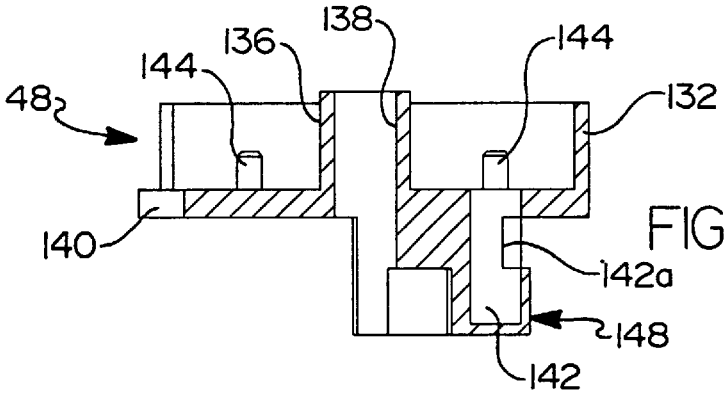
FIG 16
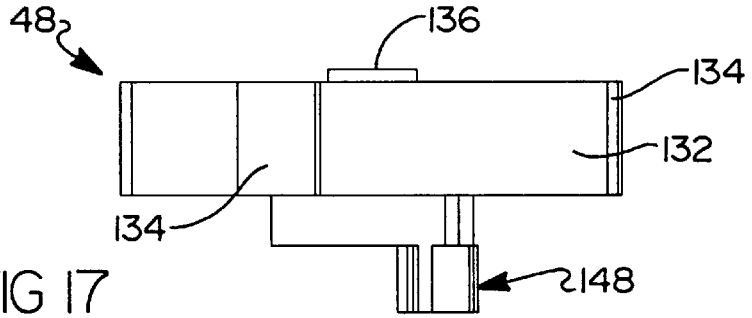
FIG 17

FIG 18
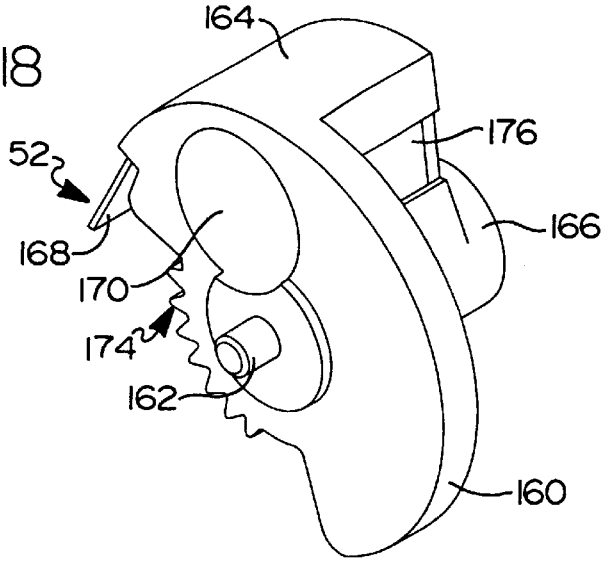
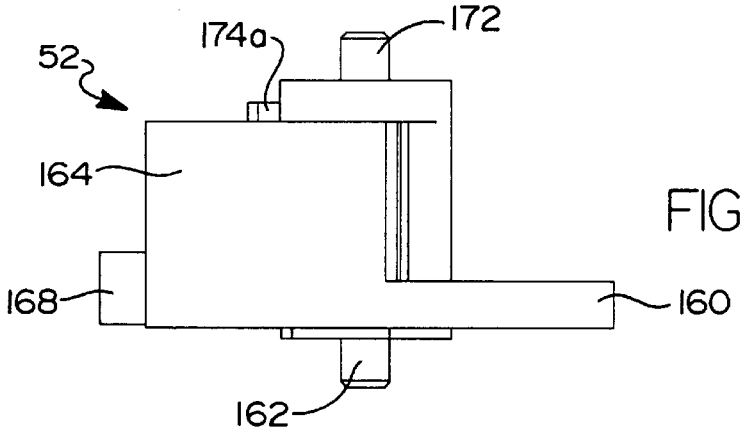
FIG 19
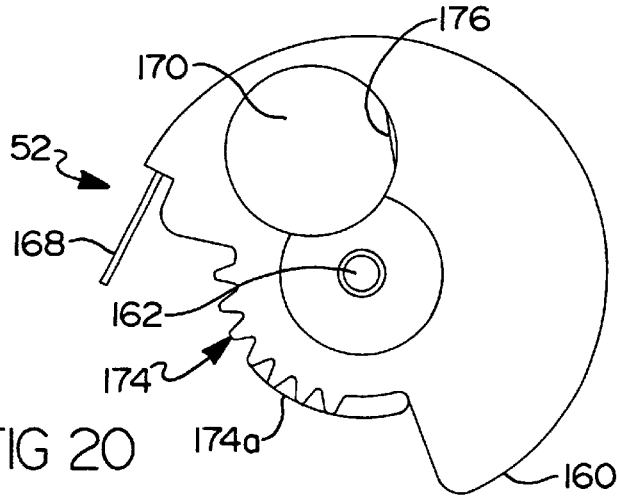
FIG 20

FIG 21
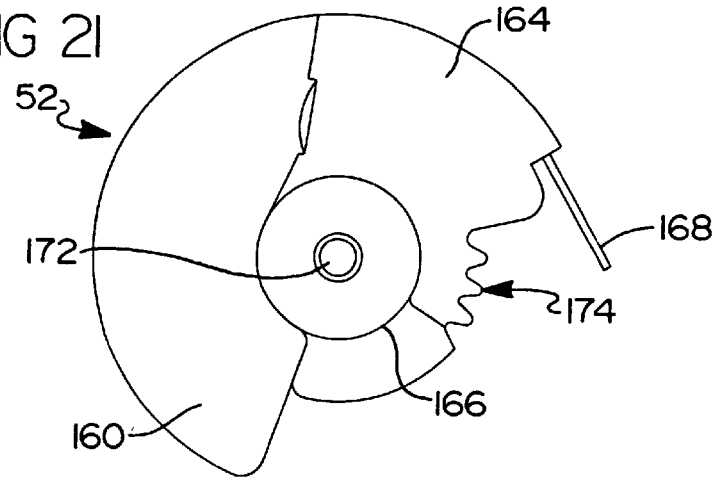
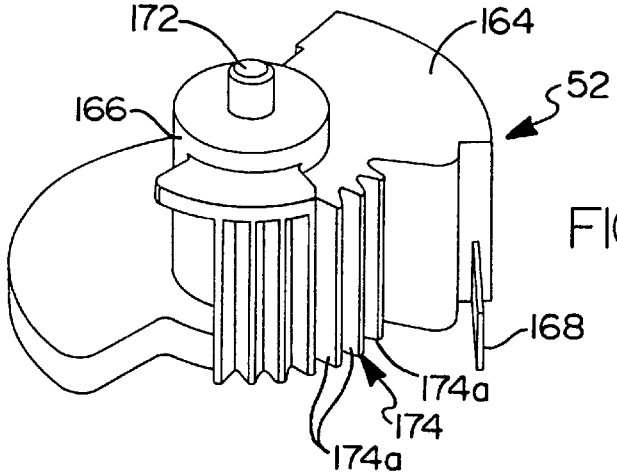
FIG 22
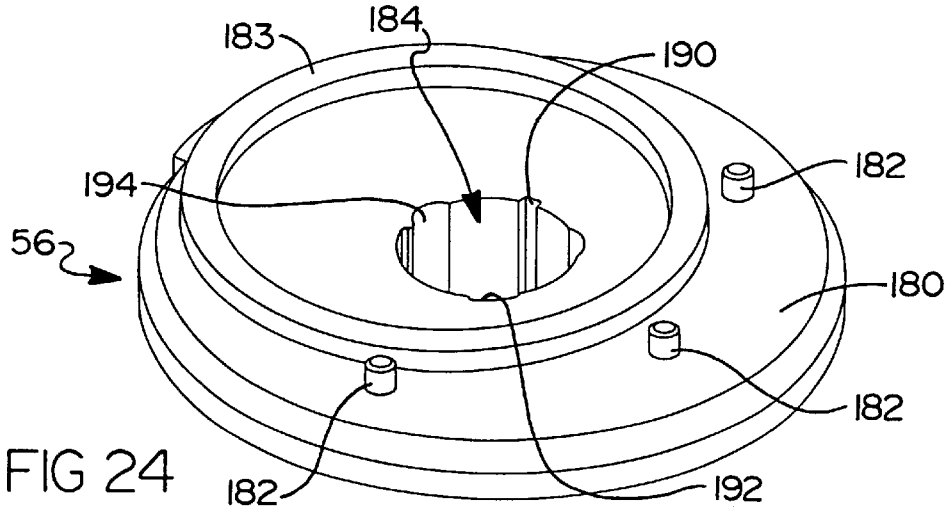
FIG 24

FIG 25
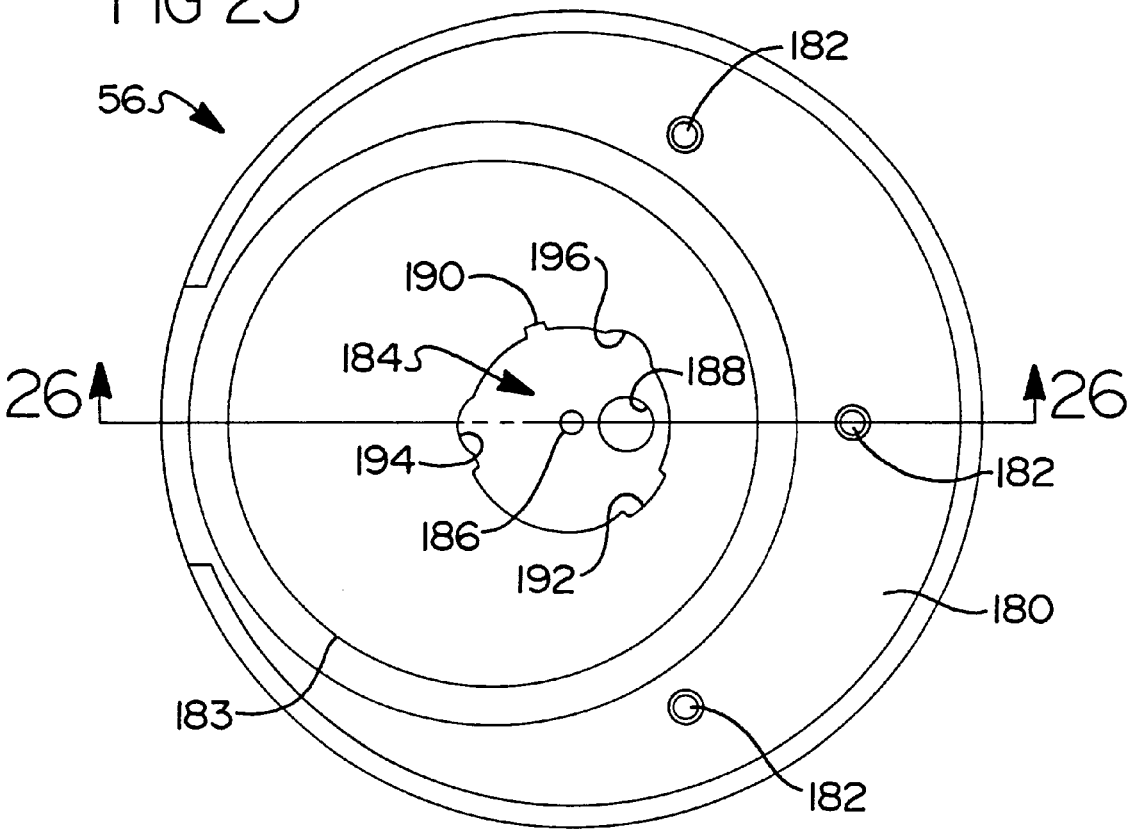
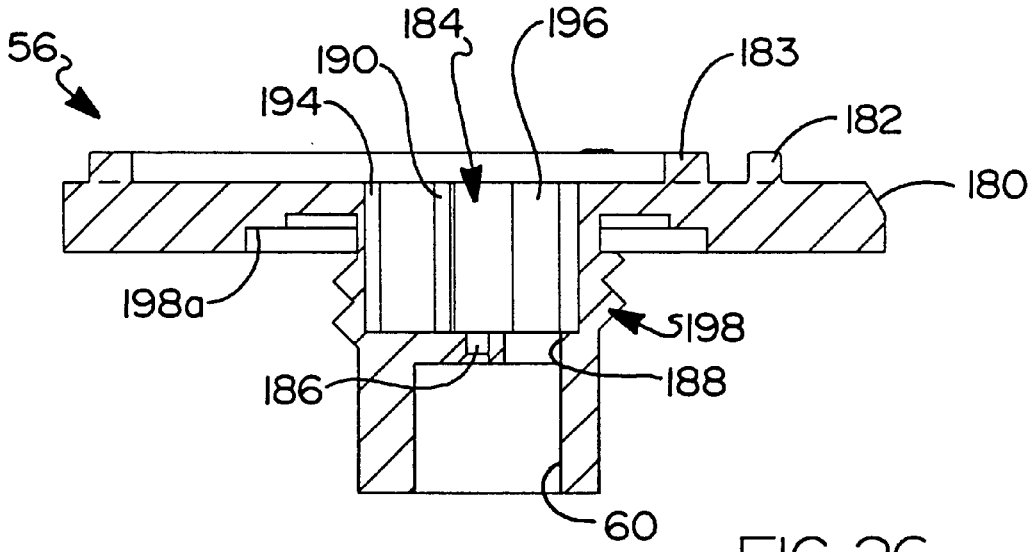
FIG 26

HIGH PRECISION FUZE FOR A MUNITION

BACKGROUND OF THE INVENTION

1. Technical Field

This invention relates to munitions, and more particularly to a high precision fuze mechanism for electronically generating a firing signal to detonate a hand grenade through the use of a magnetic signal generator incorporated in the fuze mechanism.

2. Discussion

Present day hand grenades typically incorporate pyrotechnic fuze mechanisms. These fuze mechanisms employ a fuze element that begins burning when the safety pin of the grenade is pulled from the grenade. At the end of a delay period the burning fuze element ignites a pyrotechnic element which in turn detonates the primary explosive compound of the grenade.

Such present day fuze mechanisms for grenades suffer from a number of drawbacks. For one, the delay time before detonation cannot be controlled with excellent accuracy and repeatability. Delay times typically fluctuate +/− about one to two seconds. Another drawback is that the performance of the fuze element degrades over time. This can cause further variations in the accuracy of the delay time implemented before the grenade is detonated.

It would therefore be advantageous to provide an electronically controlled fuze mechanism which would provide much greater accuracy and reliability in implementing the time delay before detonating the grenade. The difficulty with this has been the lack of electrical power available for powering a suitable electronic control circuit. With other forms of munitions that are launched from sea or air, often environmental elements such as wind are used to assist in generating electrical power for the various electronic components of the fuze mechanism of the munition. With a hand grenade, however, such environmental elements as wind force are not present in sufficient degree to reliably assist in providing power for a manually thrown hand grenade.

It would therefore be advantageous to provide a high precision fuze mechanism for a munition, such as a hand grenade, which incorporates a reliable, relatively low cost means for generating electrical power for a brief period of time, to thereby enable an electronic control system to be employed to control more precisely the time delay period prior to detonating the grenade.

It would also be advantageous to provide a fuze mechanism for a hand grenade which incorporates an electronic control circuit capable of implementing one or more time delay periods, through the use of small, lightweight electronic components, before the control circuit causes detonation of the grenade.

Still further, it would be advantageous to provide a high precision fuze mechanism for a hand grenade which incorporates an electrical impulse generator, which is only activated upon removal of a safety pin of the grenade and releasing of the grenade, and which generates sufficient electrical power to power an electronic control circuit for a short period of time, which may then be used to detonate the grenade.

Still further, it would be advantageous to provide a high precision fuze mechanism for a hand grenade which includes an electrical power generator and an electronic control circuit for implementing a precisely controlled time delay before causing detonation of the grenade, and which does not significantly increase the size, weight or overall cost of the hand grenade.

Furthermore, it would be advantageous to provide a high precision fuze mechanism for a hand grenade which includes an electrical power generator for powering an electronic control circuit, where the power generator is activated as soon as a safety pin of the grenade is withdrawn and the grenade is released, and which is not affected by the velocity with which the grenade is thrown or the orientation of the grenade through its trajectory or the position in which it lands, or by other environmental elements, before it is detonated.

SUMMARY OF THE INVENTION

The present invention relates to a high precision electromechanical fuze apparatus and method for arming and detonating a munition such as a grenade. In a preferred embodiment the fuze mechanism of the present invention comprises a magnetic signal generator which is electrically coupled to an electronic control system. The magnetic signal generator is comprised of an armature, a permanent magnet, a coil circumscribing the permanent magnet and an assembly for transmitting the electric current induced in the coil to the electronic control system. The armature is assembled in a "preloaded" state and held immovably by a safety pin. Removal of the safety pin allows the armature to rotate rapidly, thus causing an electric current to be induced in the coil of the magnetic signal generator. This signal is transmitted to the electronic control circuit which includes means for implementing at least one time delay before generating an electrical firing signal. The electrical firing signal is then used to activate an electric detonator which in turn causes detonation of a stab detonator. Detonation of the stab detonator causes detonation of the primary explosive charge of the munition.

In a preferred embodiment the armature is preloaded in the unarmed state by a coil spring. The entire assembly of the armature, a permanent magnet and the means for transmitting the electrical pulse signal are all housed within a magnetic impulse generator (MIG) housing. The armature includes a shaft to which is secured a rotor. The rotor carries the stab detonator. The coil spring is coupled to the shaft of the armature and the stored energy of the spring maintains the armature in the preloaded condition when a safety pin is inserted in an interfering relationship with a portion of the armature. Preferably a lever associated with the safety pin is employed, which must be released by the user before the safety pin can be removed. The lever is preferably spring loaded such that it automatically withdraws the safety pin as soon as the grenade is released by the user.

When the lever pin is released, thus causing the safety pin to be withdrawn, the energy stored in the spring is immediately dissipated, which causes the armature to be rotated rapidly for several revolutions. This rapid rotational movement causes a current to be electromagnetically induced in the coil. The current is transmitted through a current transmitting assembly to an electronic control system. The electronic control system incorporates at least one timer, and preferably a pair of timers, which are each initiated upon receipt of the electrical signal from the coil. After at least one, and preferably a pair, of predetermined time delays have expired, the control circuit generates an electrical firing signal which is used to detonate an electrical detonator. The stab detonator is also moved into position adjacent the electrical detonator as soon as rotation of the armature starts to occur after the safety pin is withdrawn. Detonation of the electrical detonator causes essentially simultaneous detonation of the stab detonator, which in turn causes detonation of a booster pellet disposed adjacent the primary explosive charge of the munition, and which causes detonation of the primary explosive charge.

In a preferred embodiment, the electronic control circuit includes a first timer which is initiated upon an electrical signal being received from the coil. When this timer times out, a first switch is turned on. A second timer is also initiated when the electrical signal from the coil is received. The second timer has a second time delay which is longer than the delay period of the first timer. When the second timer times out, it turns on a second switch. Only when the first and second switches are both closed does the electronic control circuit generate an electrical firing pulse to the electrical detonator to initiate the explosive train that detonates the munition.

The fuze mechanism of the present invention thus forms a high precision, lightweight, compact and relatively inexpensive means for arming and detonating a munition such as a hand grenade after a predetermined time has elapsed.

BRIEF DESCRIPTION OF THE DRAWINGS

The various advantages of the present invention will become apparent to one skilled in the art by reading the following specification and subjoined claims and by referencing the following drawings in which:

FIG. 1 is a perspective view of a hand grenade incorporating a high precision, electromechanical fuze mechanism in accordance with a preferred embodiment of the present invention;

FIG. 2 is a top view of the grenade of FIG. 1;

FIG. 3 is a cross sectional side view of the grenade of FIG. 2 taken in accordance with section line 3—3 in FIG. 2;

FIG. 6 is a perspective view of the MIG;

FIG. 7 is a bottom view of the MIG of FIG. 6;

FIG. 11 is a perspective view of the MIG housing;

FIG. 12 is a top view of the MIG housing;

FIG. 13 is a perspective view of the lower housing member;

FIG. 14 is a plan view of the lower housing member;

FIG. 15 is a bottom view of the lower housing member;

FIG. 16 is a cross sectional side view of the lower housing member taken in accordance with section line 16—16 in FIG. 14;

FIG. 17 is a side view of the lower housing;

FIG. 18 is a perspective view of the rotor;

FIG. 19 is a side view of the rotor of FIG. 18;

FIG. 20 is a top plan view of the rotor;

FIG. 21 is a bottom plan view of the rotor;

FIG. 22 is a perspective view of the rotor from the opposite orientation of that shown in FIG. 18;

FIG. 24 is a perspective view of the threaded housing member;

FIG. 25 is a top plan view of the threaded housing member;

FIG. 26 is a cross sectional side view of the threaded housing member taken in accordance with section line 26—26 in FIG. 25;

DETAILED DESCRIPTION OF THE PREFERRED EMBODIMENTS

Figure 4:
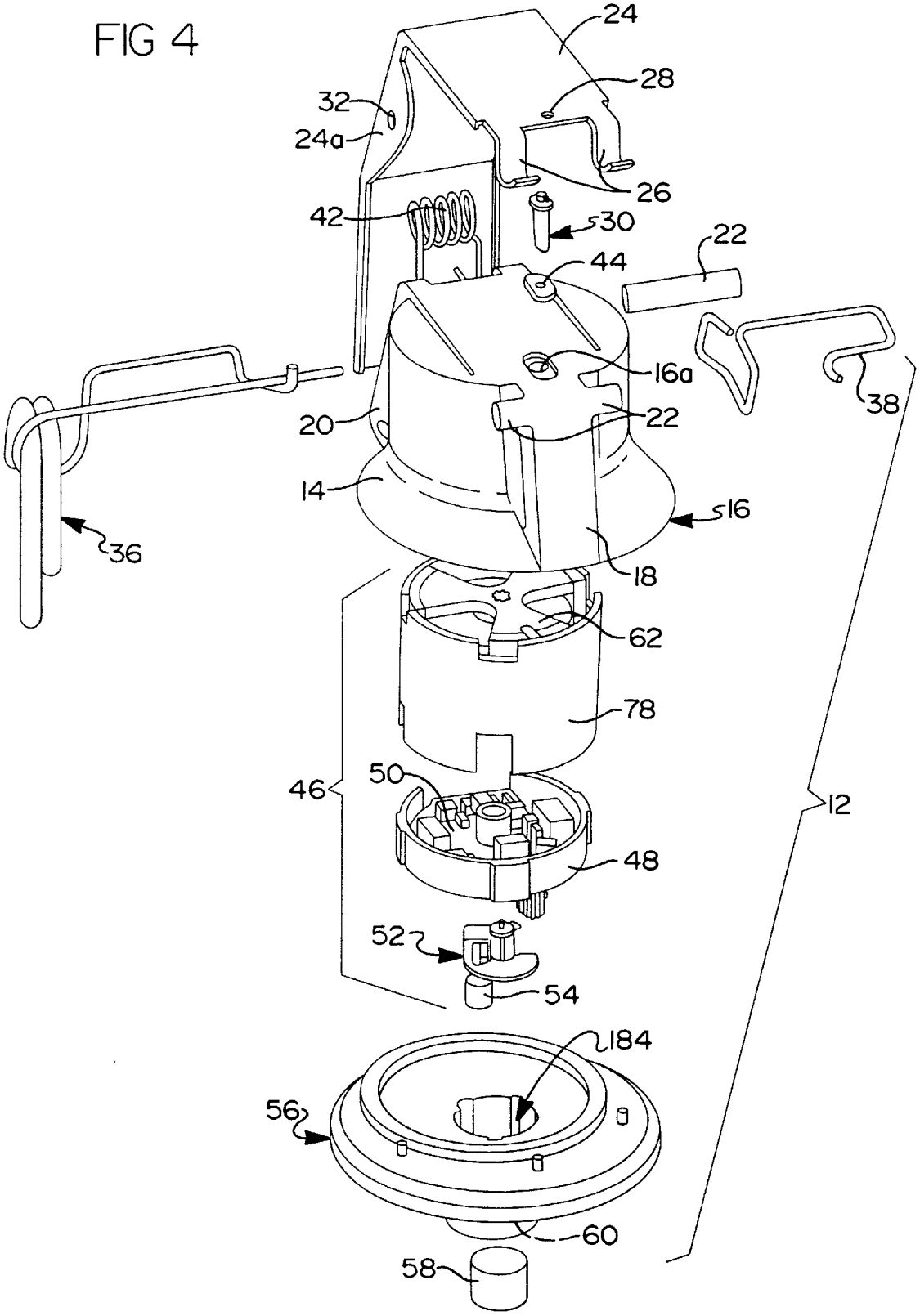
FIG. 4 is an exploded perspective view of the major subassemblies of the fuze mechanism.

Referring to FIGS. 1–3, a grenade 10 incorporating a high precision, electromechanical fuze mechanism 12 in accordance with a preferred embodiment of the present invention is shown. With specific reference to FIG. 1, the fuze mechanism 12 is secured to a body housing 14 within which is contained a high explosive composition. The body housing 14 preferably consists of an aluminum shell, approximately 0.170 inch thick, which is impregnated with a matrix of steel balls. The steel balls have a diameter of preferably about 0.125 inch.

The fuze mechanism 12 is threadably secured to a portion of the body housing 14, as will be explained further in the following paragraphs. The fuze mechanism 12 generally includes a housing 16 having a pivot portion 18 and a rear portion 20. The pivot portion 18 has a pair of integrally formed pivot members 22 upon which is secured an actuating lever 24. The actuating lever 24 is pivotably secured at end portions 26 thereof. A key-shaped aperture 28 permits a portion of a safety pin 30 to be staked to the actuating lever 24 so as to be movable with the lever. The lever includes parallel flanges **24*a* (only one being visible in FIG. 1) each having a second aperture 32, while the rear portion 20 includes a bore 34 (see FIG. 3) through which a manually graspable safety pull pin 36 extends to lock the lever 24 in place to ensure that the fuze mechanism 12 does not become accidentally armed. A shipping clip 38 is also engaged with the actuating lever 24 over a lip 40 of the fuze housing 14 (see FIG. 3) to further ensure that the actuating lever 24 cannot rotate, thereby accidentally arming the fuze mechanism 12. Accordingly, both the shipping clip 38 and the safety clip 36 must removed before the actuating lever 24 can be rotated to arm the fuze mechanism 12**.

Referring now to FIG. 4, the fuze mechanism 12 is shown in greater detail. The mechanism 12 further includes a spring 42 for biasing the actuating lever 24 against the body 14. A grommet 44 receives the safety pin 30 therethrough and seals an aperture **16*a* in the fuze housing 16 through which the safety pin 30 extends. A magnetic impulse generator (MIG) assembly 46 resides within the fuze housing 16 together with a lower housing 48 and a printed circuit board 50 disposed on the lower housing 48. A rotor 52 supports a stab detonator 54 within a recess 184 of a threaded housing member 56. The threaded housing member 56 includes a booster pellet 58 which is disposed in a cavity 60** thereof. The booster pellet preferably comprises a PBXN-5 explosive.

Figure 5:
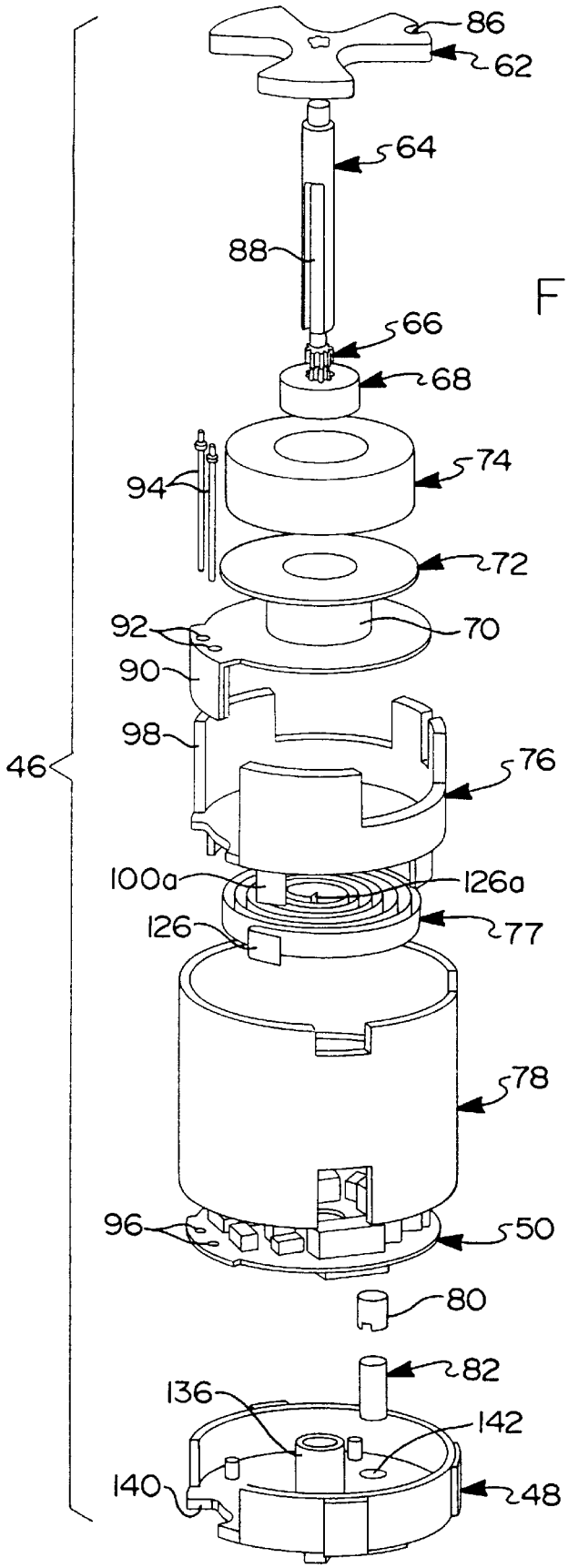
FIG. 5 is an exploded perspective view of the major components housed within the MIG housing of the fuze mechanism.

Referring now to FIG. 5, the MIG assembly 46 can be seen to include a ferrous armature 62 having an elongated shaft 64 with a pinion gear 66 at an outermost end thereof. An annular, permanent magnet 68 is disposed concentrically within a neck portion 70 of a spool-shaped bobbin member 72. An annular coil 74 is formed by winding electrically conductive wire over the neck portion 70. The entire assembly of the bobbin member 72, coil 74, permanent magnet 68 and armature 62 resides within a ferromagnetic impulse generator member (MIG) 76.

With further reference to FIG. 5, a spring 77 is disposed concentrically below the MIG 76 and within a MIG housing 78 and wound into the form shown during assembly. As will be explained in the following paragraphs, the spring 77 is coupled to the armature shaft 64 to "preload" or "pretension" the armature 62 during assembly of the fuze mechanism 12. The printed circuit board 50 is also housed within the MIG housing 78. A speed clip 80 is used to secure an electric detonator 82 within an aperture 84 in the lower housing 48.

Figure 8:
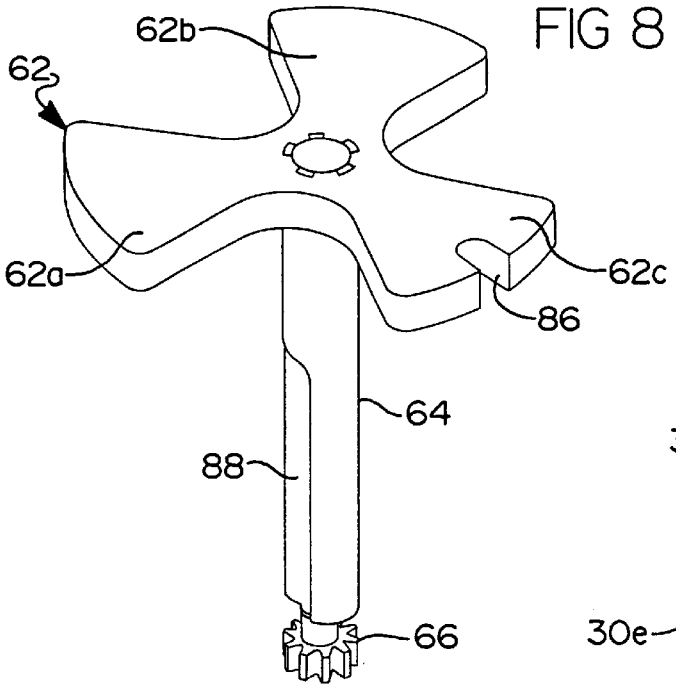
FIG. 8 is a perspective view of the armature and armature shaft coupled together.

With brief reference to FIG. 8, the armature 62 and its shaft 64 are shown coupled together. The armature 62 includes three lobes 62*a*, 62*b* and 62*c*, with lobe 62*c* having a notch 86 formed therein. The notch 86 permits the safety pin 30 to engage the armature 62 when the fuze mechanism 12 is in the unarmed state to hold the armature 62 stationary. The shaft 64 includes a notched portion 88 which engages with an inner terminal end 126*a* (FIG. 5) of the coil spring 77. In this manner the coil spring 77 is able to exert a preload force on the armature 62 when the MIG assembly 46 is assembled, while the safety pin 30 holds the armature 62 in this preloaded state until it is lifted upwardly out of engagement with the notch 86 by the force of the spring 42 acting on the actuating lever 24.

Figure 9:
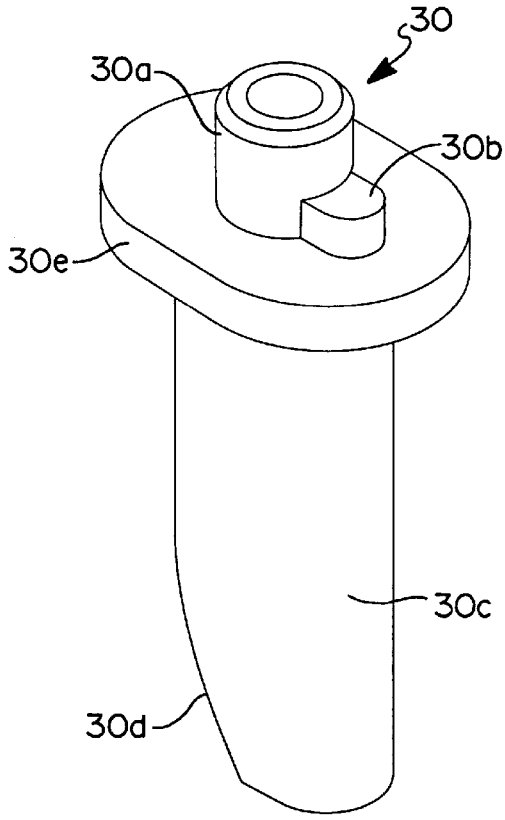
FIG. 9 is a perspective view of the safety pin.
Figure 10:
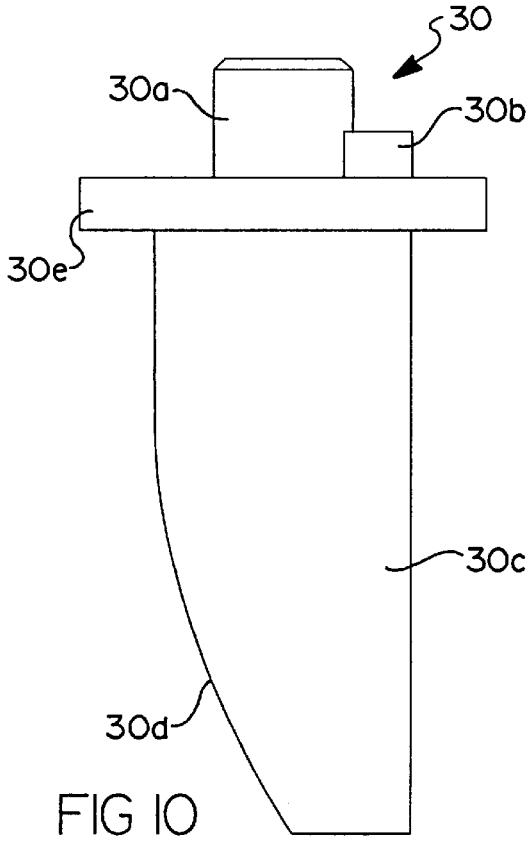
FIG. 10 is a side view of the safety pin of FIG. 9.

Referring to FIGS. 9 and 10, the safety pin 30 is shown in greater detail. The safety pin 30 includes a boss portion 30*a* having a tab 30*b* and an integrally formed body 30*c*. The body 30*c* has a tapered edge 30*d*. The boss 30*a* and tab 30*b* extend outwardly of a base 30*e*. The body 30*c* extends through the aperture 16*a* in the housing 16 (FIG. 4) and the boss 30*a* and tab 30*b* extend into the key-shaped aperture 28 in the actuating lever 24 to key the safety pin 30 to the lever 24. When the safety pin 30 is staked to the actuating lever 24, the pin 30 can only be moved longitudinally by movement of the actuating lever 24, and is not able to rotate within the aperture 16*a*.

Referring again to FIG. 5, the bobbin member 72 includes an arm portion 90 having a pair of apertures 92. The apertures 92 receive insulated, electrically conductive bobbin pins 94 therethrough which are coupled at one end to the two terminal ends of wire forming the coil 74. The bobbin pins 94 extend downwardly into apertures 96 in the printed circuit board 50 to transmit current induced in the coil 74 to the electrical components of the electronic control system mounted on the circuit board 50.

Referring now to FIGS. 5–7, it can be seen that the MIG 76 includes a notch 98 into which the arm portion 90 of the bobbin member 72 is inserted during assembly. The MIG 76 further includes a plurality of arm portions 100 protruding from a lower surface 102 (FIG. 7). The arm portions 100 fit within arcuate openings 102 (see FIG. 12) of the MIG housing 78 while a bottom wall 104 of the MIG 76 rests on a circumferential internal shoulder 106 of the MIG housing 78. Opening 108 (FIG. 12) in a bottom wall 110 of the MIG housing 78 permits the arm portion 90 of the bobbin member 72 to extend therethrough. A central aperture 112 permits a portion of the armature shaft 64 to also extend through the bottom wall 110 of the MIG housing 78.

Referring to FIGS. 11 and 12, the MIG housing 78 includes a plurality of notches 114 formed in an annular wall 105 in an upper end thereof. A plurality of notches 116 are also formed at a lower end of the annular wall 105.

With further reference again to FIGS. 5, 6 and 7, the MIG 76 also includes a peripheral wall 118 having the notch 98 and a boss 120 having a bore 122 for receiving the armature shaft 64 therethrough. Notches 124 serve to ease assembly of the bobbin member 72 into the MIG 76. A notch 104*a* is present for allowing clearance for the arm portion 90 of the bobbin member 72. The notches further help to define three equally spaced, raised lobes 125. Notch 125*a* allows clearance for the safety pin 30 so that the pin 30 can be inserted also into the notch 86 in the armature 62.

With brief reference now to FIGS. 5, 7, and 12, the arm portions 100 of the MIG 76 are received within the apertures 102 in the bottom wall 110 of the MIG housing 78 when the fuze mechanism 12 is assembled. The peripheral wall 118 of the MIG 76 also rests on the circumferential internal shoulder 106 of the MIG housing 78.

Referring further to FIGS. 5, 7 and 12, the spring 77 (FIG. 3) includes an outermost end 126 formed in a U-shape. The outermost end 126 fits around the arm 100*a* that is inserted in opening 102*a* in the bottom wall 110 of the MIG housing 78 (FIG. 12). In this manner the spring 77 is captured by the assembly of the MIG 76 and MIG housing 78 such that when the armature shaft 64 is rotated counterclockwise in the drawing of FIG. 4 the spring 77 will not simply rotate within the MIG housing 78, but will enable the armature 62 to be preloaded prior to completing assembly of the fuze mechanism 12.

Referring now to FIGS. 5 and 13–17, the lower housing 48 is shown in greater detail. The lower housing 48 includes a bottom wall 130 and a peripheral wall 132 extending about a major portion of the periphery of the bottom wall 130. The peripheral wall 132 includes a plurality of spaced apart, raised projections 134 which are adapted to fit within the notches 116 of the MIG housing 78 (FIG. 11). The bottom wall 130 also includes a boss 136 having a bore 138 which receives the armature shaft 64 therethrough. A notch 140 is formed in the bottom wall 130 to provide clearance for the arm portion 90 of the bobbin member 72 such that the arm portion 90 can extend through the bottom wall 130. A recess 142 in the bottom wall 130 supports the electric detonator 82 (FIG. 5) therein. Standoffs 144 protrude through openings in the printed circuit board 50 and are peened during assembly to secure the printed circuit board 50 thereto. The boss portion 136 also projects into the central aperture 112 in the MIG housing 78 (FIG. 12) to maintain the lower housing 48 coaxially aligned with the MIG housing 78. With specific reference to FIG. 14, a recess 146 in the bottom wall 130 provides clearance for one electronic component mounted on an undersurface of the printed circuit board 50.

In FIGS. 15–17, the lower housing 48 can also be seen to include a neck portion 148. The neck portion 148 includes a recess 150 and an extended portion 152 having a tab 154, the function of which will be explained momentarily. The extended portion 152 allows the recess 142 (FIGS. 13 and 14) to receive the electric detonator 82 (FIG. 5) such that a portion of the detonator 82 extends below the bottom wall 130. A notch 142*a* is formed in the neck portion 148 so as to open into the recess 142, thus exposing the electric detonator 82 when the detonator is inserted in the recess 142.

Referring now to FIGS. 4 and 18–22, the rotor 52 can be seen in greater detail. The rotor 52 includes a base portion 160 having a small neck portion 162. The base portion 160 also includes a raised portion 164 which is integrally formed with an upper neck portion 166. A leaf spring 168 is also integrally formed with the raised portion 164 to project generally tangentially therefrom. A recess 170 is also formed in the raised portion 164. Recess 170 houses the stab detonator 54 (FIG. 4) therein. With specific reference to FIGS. 19 and 20, the central portion 166 includes an upper neck portion 172 integrally formed therewith. The upper neck portion 172 seats within the recess 150 (FIG. 15) of the lower housing 48. The neck portion 162 seats within the threaded housing member 56 (FIG. 4), which will be described further in the following paragraphs. In this manner, the rotor 52 is mounted for rotational movement by the neck portions 162 and 172.

Referring further to FIGS. 18, 20, 21 and 22, a spur gear 174 is formed from a plurality of teeth formed on an arcuate portion of the base 160. The gear 174 engages with the gear 66 formed at the outermost end of the armature shaft 64 (FIG. 5) which enables rotation of the armature shaft 64 to cause simultaneous rotation of the rotor 52.

Figure 27:
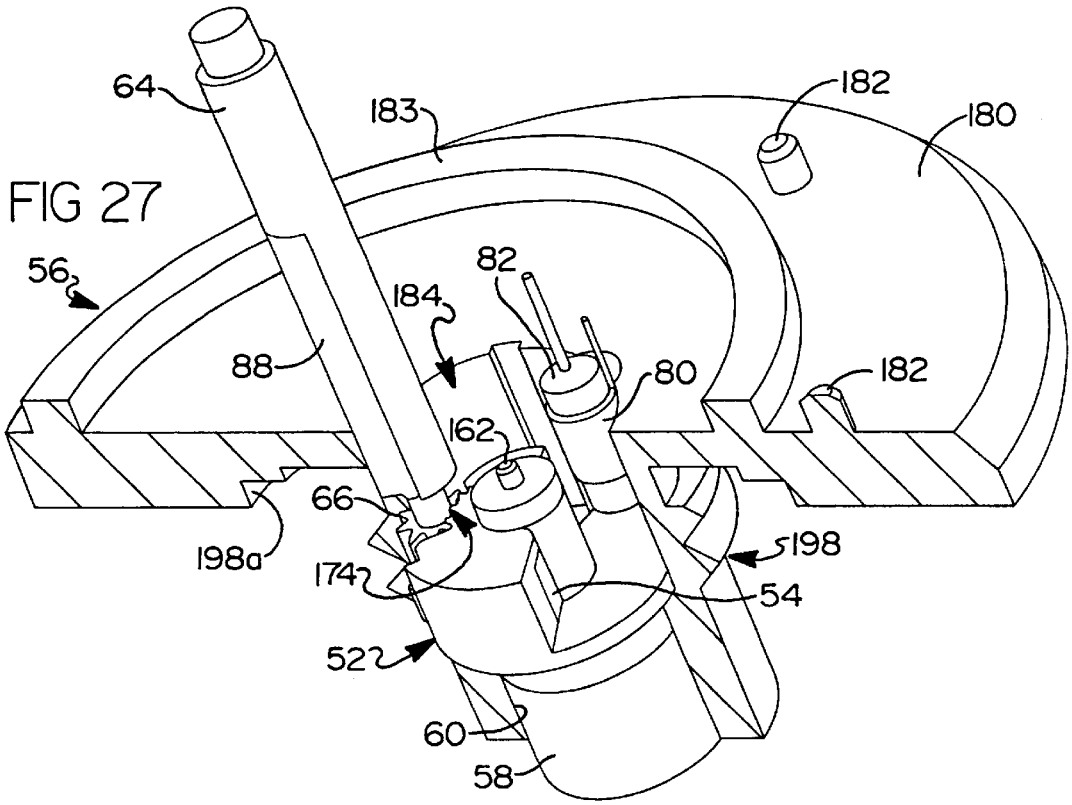
FIG. 27 is a partial assembly view of the rotor and lower housing showing the rotor in the position it is in before the fuze mechanism is armed.

With further reference to FIGS. 18–20, the raised portion 164 can be seen to include an opening 176 formed so as to open into the recess 170. When the rotor 52 is rotated by gear 66 (FIG. 5), the rotor 52 is moved into position abutting the lower portion 148 of the lower housing 48 with the electric detonator 82 (FIG. 5) disposed closely adjacent the stab detonator 54 within the recess 170 (FIG. 27). It will be appreciated then that the rotor 52 can only rotate about a limited arc, preferably about a maximum 90° arc. The gear 174 of the rotor 52 further disengages from the armature gear 66 after the rotor 52 has moved about 75° from its initial position. This is accomplished by forming teeth 174*a* of the gear 174, as shown in FIG. 20, such that these teeth provide an area of clearance, designated by reference numeral 178, where the pinion gear 66 can rotate freely without engaging the rotor 52. Continued rotation of the pinion gear 66 and its armature shaft 64 is important for the continued electromagnetic generation of current in the coil 74, which powers the components of the printed circuit board 50. When the rotor 52 rotates into its armed position, the leaf spring 168 will lock the rotor 52 in the armed position by engagement with a portion of the threaded housing member 56, as will be explained further momentarily.

Figure 23:
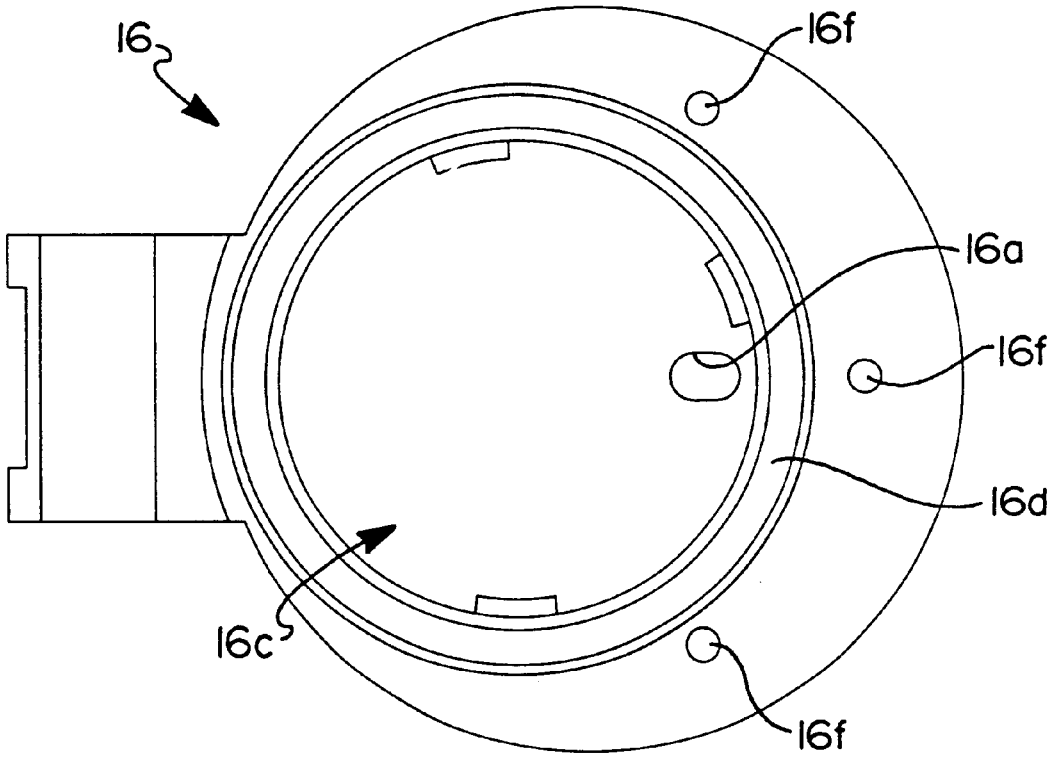
FIG. 23 is a bottom plan view of the fuze housing.

Referring to FIG. 23, the undersurface of the fuze housing 16 can be seen. The undersurface includes three recesses 16*f* formed in a flange portion 16*b* and a hollow area 16*c* for receiving the MIG assembly 46. An annular recess 16*d* circumscribes an opening 16*e* leading to the hollow area 16*c*.

Referring now to FIGS. 4 and 24–26, the threaded housing member 56 can be seen in greater detail. The threaded housing member 56 includes a base portion 180 having a plurality of upstanding tabs 182. The tabs 182 fit within recesses 16*f* formed in the undersurface of the fuze housing 16 (FIG. 23) to affix the threaded housing member 56 to the housing 16.

Referring to FIGS. 25 and 26, the base portion 180 further includes a raised circumferential rim 183 and the recess 184. The raised circumferential rim 183 engages within the annular recess 16d of the housing 16 (FIG. 23) when the threaded housing member 56 is attached to the housing 16, and is secured thereto by ultrasonically welding the two components. Recess 184 includes a secondary recess 186 and a through aperture 188. The through aperture 188 receives therethrough a portion of the electric detonator 82.

With further reference to FIG. 25, a groove 190 is formed in the recess 184. The groove 190 receives tab 154 of the lower housing member 48 such that the member 48 is keyed to the threaded housing 56 and is therefore not able to rotate. A second groove 192 receives the leaf spring 168 of the rotor 52 (FIGS. 18–22) such that once the rotor 52 is rotated 900 into the armed position the leaf spring 168 is engaged in the groove 192 and locks the rotor 52 in the armed position.

The recess 184 further includes an arcuate groove 194 which provides clearance for the portion of the armature shaft 64 and its pinion gear 66 such that same are able to extend into the recess 184 so that the pinion gear 66 can engage gear 174 of the rotor 52. Arcuate groove 196 provides clearance for area 155 (FIG. 15) of the lower portion of the lower housing 48.

With further reference to FIGS. 3 and 26, the threaded housing member 56 further includes a threaded neck portion 198 which is adapted to engage with a threaded aperture 199 in the grenade body housing 14 (FIG. 3) of the grenade 10. The threaded housing member 56 is attached to the grenade body housing 14 simply by screwing the threaded neck portion 198 into the threaded recess 199 in the body 14. At the lower end of the neck portion 198 is the cavity 60 in which the booster pellet 58 is inserted.

With brief reference to FIGS. 3 and 26, an O-ring 195 (FIG. 3) is placed around a boss 197. The O-ring 195 fits into an annular recess 198a (FIG. 26) to help seal the threaded housing member 56 to the body housing 14.

Referring now to FIG. 27, the orientation of the rotor 52 relative to the electric detonator 82 shown when the grenade 10 is in the unarmed state. After the shipping clip 38 and the safety pull pin 36 are both removed by the user, and the grenade 10 is released, the spring force provided by the lever spring 42 urges the actuating lever 24 outwardly. This outward movement lifts the safety pin 30 out of the notch 86 in the armature 62 (FIG. 8). The armature 62 immediately begins to spin to dissipate the energy stored by the spring 77. The spinning of the armature 62 causes the armature lobes 62*a*, 62*b* and 62*c* to move in and out of alignment with the lobes 125 of MIG 76. When in alignment (i.e., "in phase"), the magnetic flux linking the coil 74 is maximized. When the lobes 62*a*, 62*b*, 62*c* are in between the lobes 125, the flux is minimized. The result is an alternating current which is induced in the coil 74. This alternating current is transmitted through the electrically conductive bobbin pins 94, which are electrically coupled to the ends of the wire comprising the coil 74, and transmitted to the printed circuit board assembly 50.

Figure 28:
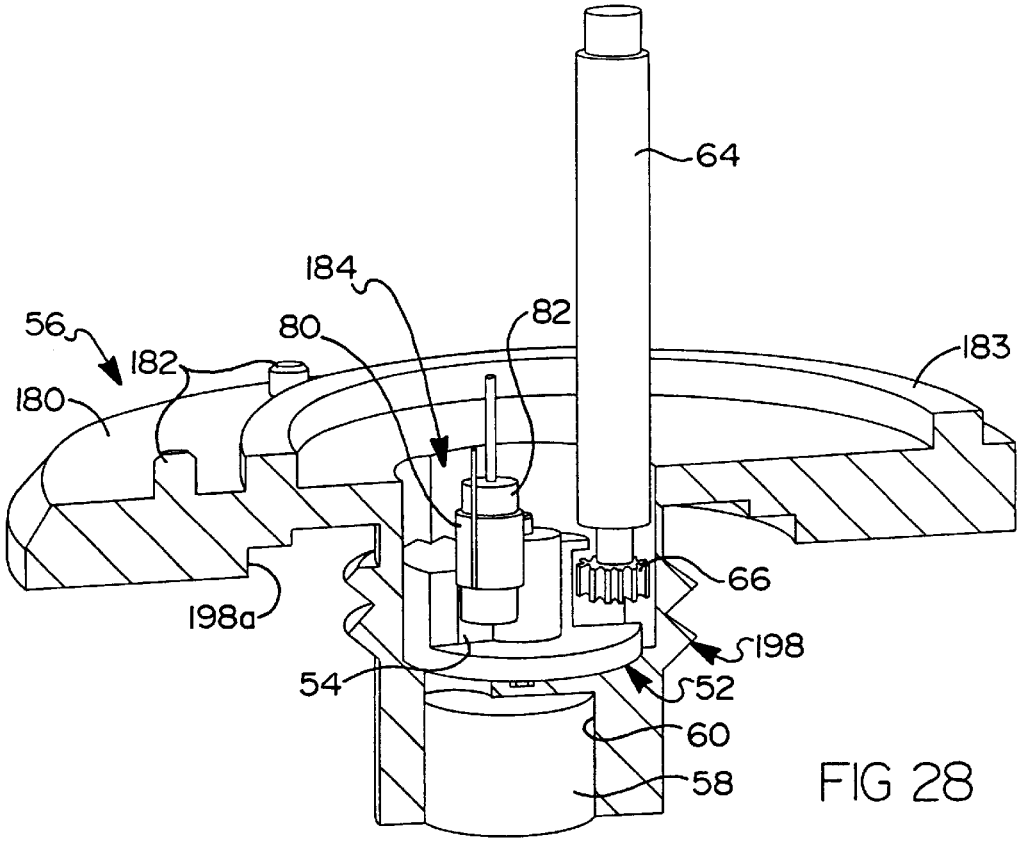
FIG. 28 is a partial assembly view showing the rotor in FIG. 26 having been moved approximately 90 degrees into an armed position adjacent the electric detonator.

As explained hereinbefore, as soon as the armature shaft 64 begins to rotate, the pinion gear 66, which is intermeshed with gear 174 of the rotor 52, causes immediate rotation of the rotor 52. This degree of rotation is approximately about 75° before the pinion gear 66 disengages from the rotor gear 174. The momentum of the rotor carries it approximately an additional 15° (as shown in FIG. 28), whereupon the leaf spring 168 of the rotor 52 engages within groove 192 (FIG. 24) of the threaded housing 56, thereby essentially locking the rotor 52 in the armed position. When the rotor 52 rotates fully approximately 90°, the stab detonator 54 is placed closely adjacent the electric detonator 82, as shown in FIG. 28.

Figure 29:
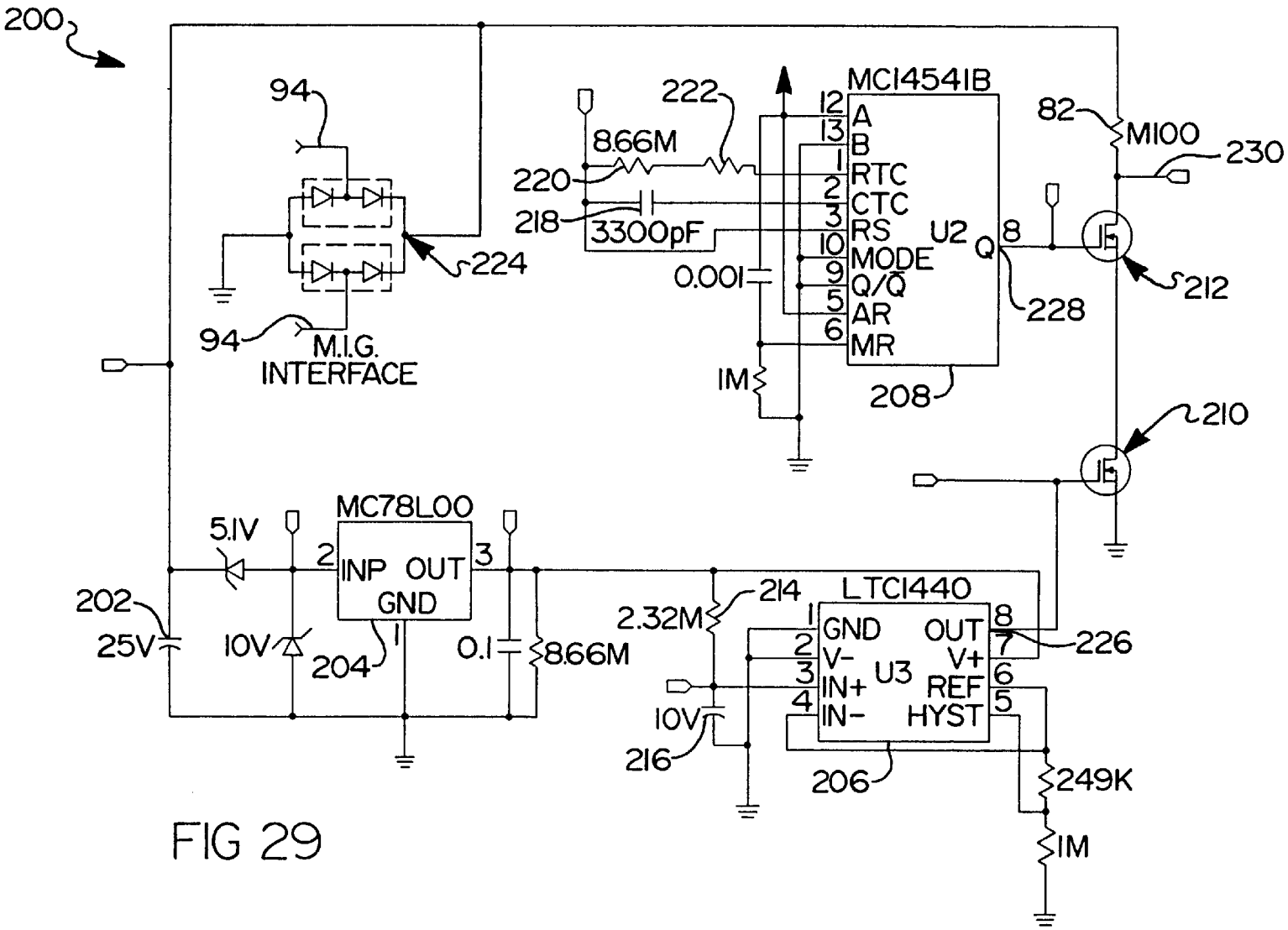
FIG. 29 is an electrical schematic diagram of the electronic control circuit of the fuze mechanism.

Referring now to FIG. 29, an electronic control circuit 200 of the grenade 10 is illustrated. Electronic control circuit 200 is formed on the printed circuit board 50 and generally comprises a capacitor 202 for storing the electric energy received from the bobbin pins 94, a voltage regulator 204, a comparator 206, a programmable timer 208, a first field effect transistor (FET) 210 and a second FET 212. Associated with the comparator 206 is a resistor 214 and a capacitor 216, which together form an RC time constant network. The programmable timer 208 makes use of capacitor 218 and resistors 220 and 222, the values of which determine the frequency of a clock signal applied to the programmable timer 208.

In operation, when the electrical signal is received from the electrically conductive bobbin pins 94, the entire circuit 200 is immediately powered up and the voltage signal is full wave rectified by a rectifier circuit 224. Capacitor 202 is charged and the voltage across this capacitor is then divided down and regulated to approximately 4.0 volts DC to provide operating voltage for the two integrated circuits 206 and 208.

The comparator 206 is used to provide safe separation and turns on (i.e., closes), the first FET 210 approximately 4.5 seconds after the application of power to the circuit 200. This time delay is achieved by charging capacitor 216 through resistor 214 and comparing the voltage across capacitor 216 to the comparator's internal reference voltage. Once the capacitor 216 reaches the reference voltage, the comparator's 206 output 226 is used to turn on the FET 210.

The programmable timer 208 turns on FET 212 after an approximately six second (plus/minus 0.25 seconds) time delay from the application of power to the circuit 200. The programmable timer 208 utilizes the clock signal generated by capacitor 218 and resistors 220 and 222. Once the timer 208 has counted the 128 clock signal edges at the set frequency, its output 228 turns on the FET 212. Once FETs 212 and 210 are turned on, the remaining energy stored by capacitor 202 is discharged at output 230 to the electric detonator 82. Accordingly, it is only when both of the FETs 212 and 210 are turned on that the electric detonator 82 can be fired.

It will be appreciated then that the fuze mechanism 12 forms a high precision and reliable means for detonating the grenade 10. The MIG assembly 46 forms a relatively low cost means for reliably providing power to the electronic control circuit 200, which in turn precisely controls the delay time before causing detonation of the grenade 10. The fuze mechanism 12, once armed, is not affected by the velocity with which the grenade 10 is thrown, by its trajectory or by the orientation in which the grenade 10 lands. The delay time implemented by the electronic control circuit 200 provides a delay time accuracy within about +/− 0.25 seconds over a temperature range of about −40° F. to +140° F. The electronic control provided by the fuze mechanism 12 further provides a longer shelf life for the grenade 10.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A fuze apparatus for a munition, said fuze apparatus comprising:

a magnetic signal generator having a rotatably movable armature for generating an electrical pulse signal upon rotational movement of said armature;

a spring member pretensioned and operably associated with said armature;

a pin for engaging said armature and holding said armature immovably;

an actuating member associated with said pin for removing said pin from engagement with said armature, thereby allowing said armature to rotate in response to a biasing force from said spring member under pretension;

a rotor movable in response to rotational movement of said armature for moving a first detonator in an armed position wherein said first detonator can detonate an explosive material of said munition; and an electronic time delay control circuit responsive to said electrical pulse signal generated by said magnetic signal generator for sensing movement of said armature and for generating an electrical firing signal after a predetermined time delay; and a second detonator responsive to said electrical firing signal for detonating said first detonator upon generation of said electrical firing signal.

2. The apparatus of claim 1, wherein said magnetic signal generator further comprises:

a permanent magnet; and a conductor disposed around said permanent magnet.

3. The apparatus of claim 1, further comprising an actuating member spring associated with said actuating member; and a safety pin for holding said actuating member in a unactuated state against a biasing force of said actuating member spring.

4. The apparatus of claim 1, wherein said armature comprises an elongated shaft having a pinion gear;

and wherein said rotor comprises a spur gear;

and wherein said pinion gear engages said spur gear when said armature rotates to thereby move said rotor rotationally a predetermined degree of travel.

5. The apparatus of claim 1, wherein said magnetic signal generator comprises a magnetic impulse generator (MIG) housing for substantially encasing a coil and said permanent magnet.

6. The apparatus of claim 1, wherein said magnetic signal generator further comprises a bobbin assembly for transmitting said electrical pulse signal to said electronic control circuit.

7. A fuze apparatus for a munition, said fuze apparatus comprising:

a housing;

an actuating member operably associated with said housing;

an electrical signal generator assembly disposed within said housing, said electrical signal generator being able to generate an electrical signal in response to movement of said actuating member; and an electronic time delay control circuit responsive to said electrical signal for generating an electrical firing signal operable to detonate a detonation device.

8. The apparatus of claim 7, wherein said electronic time delay control circuit includes at least one programmable timer for delaying generation of said electrical firing signal for a predetermined time period after said electrical signal is generated.

9. The apparatus of claim 7, wherein said electronic control circuit includes;

a capacitor for receiving and storing electrical energy from said electrical signal;

a first timer operable in response to a signal from said capacitor for generating a first switching signal after a first predetermined time delay; and a first electronic switch responsive to said first switching signal for coupling said capacitor electrically to said detonation device, whereby the remaining electrical energy stored by said capacitor is used to generate said electrical firing signal.

10. The apparatus of claim 9, wherein said electronic control circuit includes:

a second timer for generating a second switching signal after a second predetermined time delay in response to generation of said electrical signal;

a second electronic switch responsive to said second switching signal for coupling said capacitor electrically to said detonation device;

and wherein said electrical firing signal is generated only after said first and said electronic switches close.

11. The apparatus of claim 7, wherein said electrical signal generator comprises:

an movable armature;

a permanent magnet disposed adjacent said armature;

a coil disposed adjacent said permanent magnet; and a signal transmitting assembly for transmitting said electrical signal, generated upon movement of said armature, to said electronic control circuit.

12. The apparatus of claim 11, wherein said electrical signal generator further comprises a magnetic impulse generator (MIG) housing for housing said coil, said permanent magnet, said signal transmitting assembly and said armature.

13. The apparatus of claim 12, further comprising a spring associated with said armature for providing a preloading force to said armature, whereupon actuation of said actuating member causes said armature to be driven rotationally by said spring until energy stored by said spring is completely dissipated.

14. A fuze apparatus for generating an electrical signal suitable for detonating a munition, wherein the munition has an electrically responsive detonating device, said fuze apparatus comprising:

a housing;

a safety member operably associated with said housing;

an electrical pulse generator disposed within said housing, said electrical pulse generator having a movable armature and being operable to generate an electrical pulse signal in response to rotational movement of said armature;

an electronic time delay control circuit responsive to said electrical pulse signal for generating an electrical firing signal after the expiration of a time delay period;

a spring for providing a preloading force to said armature during assembly of said fuze apparatus, said armature being held immovably under said preloading force by a movable safety member;

wherein movement of said safety member results in said armature being driven rotationally by said preloading force, thereby causing said electrical pulse generator to generate said electrical pulse signal.

15. The fuze apparatus of claim 14, wherein said electrical pulse generator comprises:

a permanent magnet disposed adjacent said armature;

a coil disposed adjacent said permanent magnet;

a signal transmitting assembly for transmitting said electrical pulse signal to said electronic control signal; and a magnetic impulse generator housing for housing said coil, said permanent magnet and said signal transmitting assembly.

16. The fuze apparatus of claim 14, wherein said armature includes a shaft having a first gear component; and wherein said fuze apparatus further comprises a rotor having second gear component; and wherein said first gear intermeshes with said second gear to drive said rotor rotationally within housing; and wherein said rotor includes a detonating device operable to be moved into position to be detonated upon movement of said safety member.

17. A method for forming a fuze for detonating a munition, comprising the steps of:

mounting a movable armature for rotational movement within a housing and placing said movable armature under a pretensioning force during assembly of said fuze;

securing said armature immovably with a safety member to ensure said armature remains stationary until said safety member is moved by a user;

using a permanent magnet and a coil associated with said magnet to cause an electrical signal to be generated in said coil when said safety member is moved and said armature is thereafter automatically driven rotationally relative to said permanent magnet by said pretensioning force; and using said electrical signal to cause detonation of said munition.

18. The method of claim 17, further comprising the step of:

using an electronic control circuit responsive to said electrical signal to implement a time delay before generating an electrical detonation signal, whereafter said electrical detonation signal is used to detonate said munition.

19. A fuze apparatus for detonating a munition, said fuze apparatus comprising:

a housing;

a safety member operably associated with said housing and moveable relative to said housing;

a system for generating a signal when said safety member is actuated by a user;

an electronic time delay circuit responsive to said signal for generating an electrical firing signal after the expiration of a predetermined time delay; and a detonation device responsive to said electrical firing signal for detonating said munition.

20. The apparatus of claim 19, wherein said system for generating a signal comprises a magnetic signal generator comprising:

a movable armature;

a permanent magnet disposed adjacent said armature;

a spring for preloading said armature, said safety member being operable to hold said armature in said preloaded orientation against a biasing force of said spring; and a coil disposed adjacent said permanent magnet.

* * * * *

UNITED STATES PATENT AND TRADEMARK OFFICE

CERTIFICATE OF CORRECTION

PATENT NO. : 6,272,995 B1 
DATED : August 14, 2001
INVENTOR(S) : William Marc Schmidt et al.

It is certified that error appears in the above-identified patent and that said Letters Patent is hereby corrected as shown below:

Column 4,
Line 46, after "must" insert -- be --

Column 8,
Line 2, "900°" should be -- 90° --

Column 9,
Line 65, delete "immovably" and substitute -- immovable -- therefor

Column 10,
Line 60, "includes;" should be -- includes: --

Column 11,
Line 13, after "said" insert -- second --
Line 16, delete "an" and substitute -- a -- therefor
Line 51, delete "immovably" and substitute -- immovable -- therefor Column 12,
Line 20, delete "immovably" and substitute -- immovable -- therefor Signed and Sealed this Fourteenth Day of May, 2002

*Attest:*

*Attesting Officer*

JAMES E. ROGAN
*Director of the United States Patent and Trademark Office*